US007874396B2

(12) United States Patent
Sewell et al.

(10) Patent No.: US 7,874,396 B2
(45) Date of Patent: Jan. 25, 2011

(54) MULTIPLE FUNCTION CONTROL SYSTEM FOR WORK MACHINE

(75) Inventors: Cody L. Sewell, Perry, OK (US); Jacob A. Hamburger, Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 0 days.

(21) Appl. No.: 12/624,270

(22) Filed: Nov. 23, 2009

(65) Prior Publication Data

US 2010/0089684 A1 Apr. 15, 2010

Related U.S. Application Data

(63) Continuation of application No. 11/694,598, filed on Mar. 30, 2007, now Pat. No. 7,621,366.

(60) Provisional application No. 60/743,991, filed on Mar. 30, 2006.

(51) Int. Cl.
*B60K 26/00* (2006.01)

(52) U.S. Cl. ..... 180/324; 180/333

(58) Field of Classification Search ..... 180/324, 180/333, 320, 321, 322, 305, 335, 336; 212/301, 212/302; 37/352
See application file for complete search history.

(56) References Cited

U.S. PATENT DOCUMENTS

| | | | |
|---|---|---|---|
| 4,057,130 | A | 11/1977 | Robertson |
| 4,091,889 | A | 5/1978 | Brown et al. |
| 5,056,985 | A | 10/1991 | Johnson et al. |
| 5,333,515 | A | 8/1994 | Schneider |
| 5,918,694 | A | 7/1999 | Miller et al. |
| 6,704,637 | B1 | 3/2004 | Hrazdera et al. |
| 6,837,142 | B1 | 1/2005 | Poplawski et al. |
| 6,896,088 | B2 | 5/2005 | Dahl et al. |
| 2008/0183356 | A1 | 7/2008 | Kale et al. |
| 2009/0056322 | A1 | 3/2009 | Brinkman et al. |

FOREIGN PATENT DOCUMENTS

| | | | |
|---|---|---|---|
| JP | 6081371 | A1 | 3/1994 |
| JP | 6322792 | A1 | 11/1994 |

*Primary Examiner*—Paul N Dickson
*Assistant Examiner*—Drew Brown
(74) *Attorney, Agent, or Firm*—Tomlinson Rust McKinstry Grable

(57) ABSTRACT

A control system for a work machine. The control system allows an operator to selectively maintain control of a ground drive, a work tool, or both the ground drive and the work tool. The system provides a foot pedal movable between multiple positions. The foot pedal allows an operator to selectively hold the position of one or both of the ground drive control and work tool control. When the foot pedal is in a first position, the work tool control and ground drive control are not affected. When the foot pedal is in a second position, the position of the work tool control is maintained, while the ground drive control is not affected. When the foot pedal is in a third position, the position of the work tool control is maintained and the position of the ground drive control is maintained. A work tool control lock is used to prevent the work tool control from engaging when the foot pedal is in the second position or the third position.

14 Claims, 2 Drawing Sheets

MULTIPLE FUNCTION CONTROL SYSTEM FOR WORK MACHINE

CROSS REFERENCE TO RELATED APPLICATION

This application is a continuation of U.S. Ser. No. 11/694,598 filed Mar. 30, 2007, which claims the benefit of provisional patent application Ser. No. 60/743,991 filed on Mar. 30, 2006, the entire contents of which are incorporated herein by reference.

FIELD OF THE INVENTION

The present invention relates to the field of work machines, and particularly to a system for controlling multiple functions of a work machine.

SUMMARY OF THE INVENTION

The present invention comprises a control system for use with a work machine. The control system comprises a ground drive control, a work tool control, and a control stabilizer. The ground drive control and the work tool control are each movable between a plurality of positions. The control stabilizer is operatively connected to the ground drive control and the work tool control. The control stabilizer is adapted to selectively maintain the position of the ground drive control, to maintain the position of the work tool control or to simultaneously maintain both the position of the ground drive control and the position of the work tool control.

In an alternative embodiment, the invention comprises a method for controlling a work machine comprising a ground drive, a work tool, and a control stabilizer. The method comprises the steps of setting a parameter of the work tool, establishing a speed of the ground drive, and engaging the control stabilizer. The control stabilizer is adapted to selectively maintain the speed of the ground drive, maintain the parameter of the work tool, or maintain both the speed of the ground drive and the parameter of the work tool

DETAILED DESCRIPTION OF THE PREFERRED EMBODIMENTS

Figure 1:
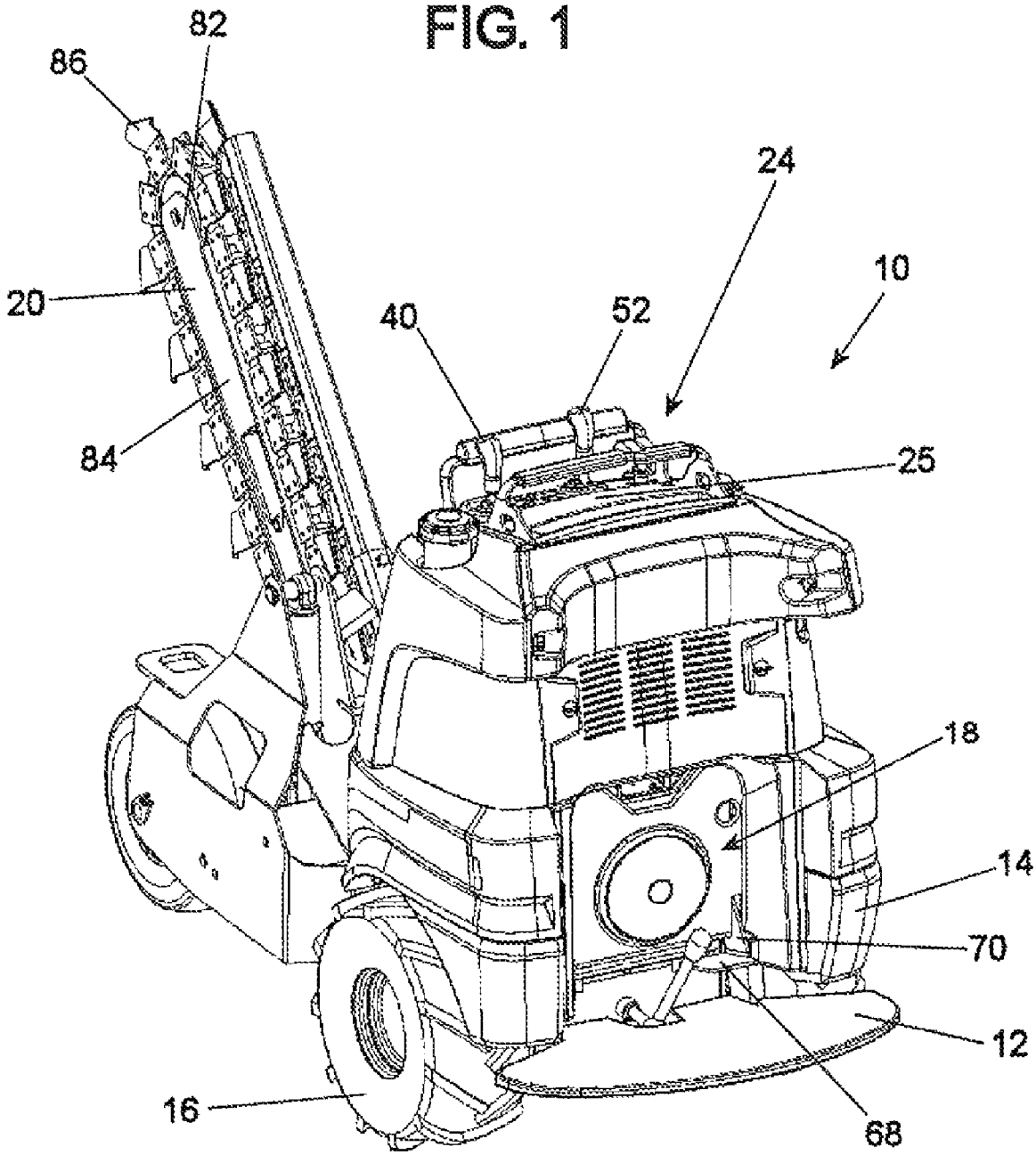
FIG. 1 is a front perspective view of a work machine having a control system built in accordance with the present invention.

Referring to the Figures in general and FIG. 1 in particular, therein shown is a work machine 10 for use with the present invention. The present invention comprises a control system to allow an operator to easily maintain a particular operation of the machine. The work machine may be a tool carrier with the ability to operate interchangeable work tools or may be a dedicated machine such as a trencher as shown in FIG. 1. On most work machines, whether seated or stand-up operated machines, the operator is provided with multiple control levers for engaging and operating various functions of the work machine. These various functions include ground speed, direction (forward or reverse), steering, work tool positioning, and work tool engagement.

There are generally two types of ground drive operating modes. A first is where the operator needs to continually vary the ground drive direction and speed, such as when moving the machine between locations or operating work tool functions such as a loader. Alternatively, the operator may have the need to maintain the machine travel speed at a very controlled and possibly slow rate, such as while trenching.

Similarly there are generally two distinct work tool modes of operation. A first is where the work tool requires continuous manipulation by the operator, such as during operation of loader arms or a bucket. Alternatively, the work tool may need to be placed in continuous operation, as is the case when a trenching mechanism is engaged.

Ground drive controls and work tool controls are generally levers, and are most commonly of the 'spring return-to-neutral' or 'hold-to-run' type. Because these types of controls require continuous operator intervention (actuation), it is sometimes laborious and difficult to properly control the machine function during the work mode considering movement of the machine and the duration of a job. Additionally, due to the different control characteristics associated with different work modes, not requiring hold-to-run can be advantageous by freeing up an operator's hand to perform other functions or for stability.

The work machine 10 shown in FIG. 1 comprises a platform 12 for an operator (not shown) to stand on the machine during operation. The platform 12 is preferably located on a back end 14 of the work machine 10, and provides a standing location for an operator that allows for operation of the machine functions. Alternatively, the operator platform 12 may comprise a seat for the operator. The work machine 10 further comprises at least one ground supporting drive member 16, a ground drive system 18, a work tool 20, a work tool drive 22, and a control station 24 having a control panel 25. The at least one ground supporting drive member 16 is shown as wheels or tires. Alternatively, tracks or other ground drives can also be used.

Figure 2:
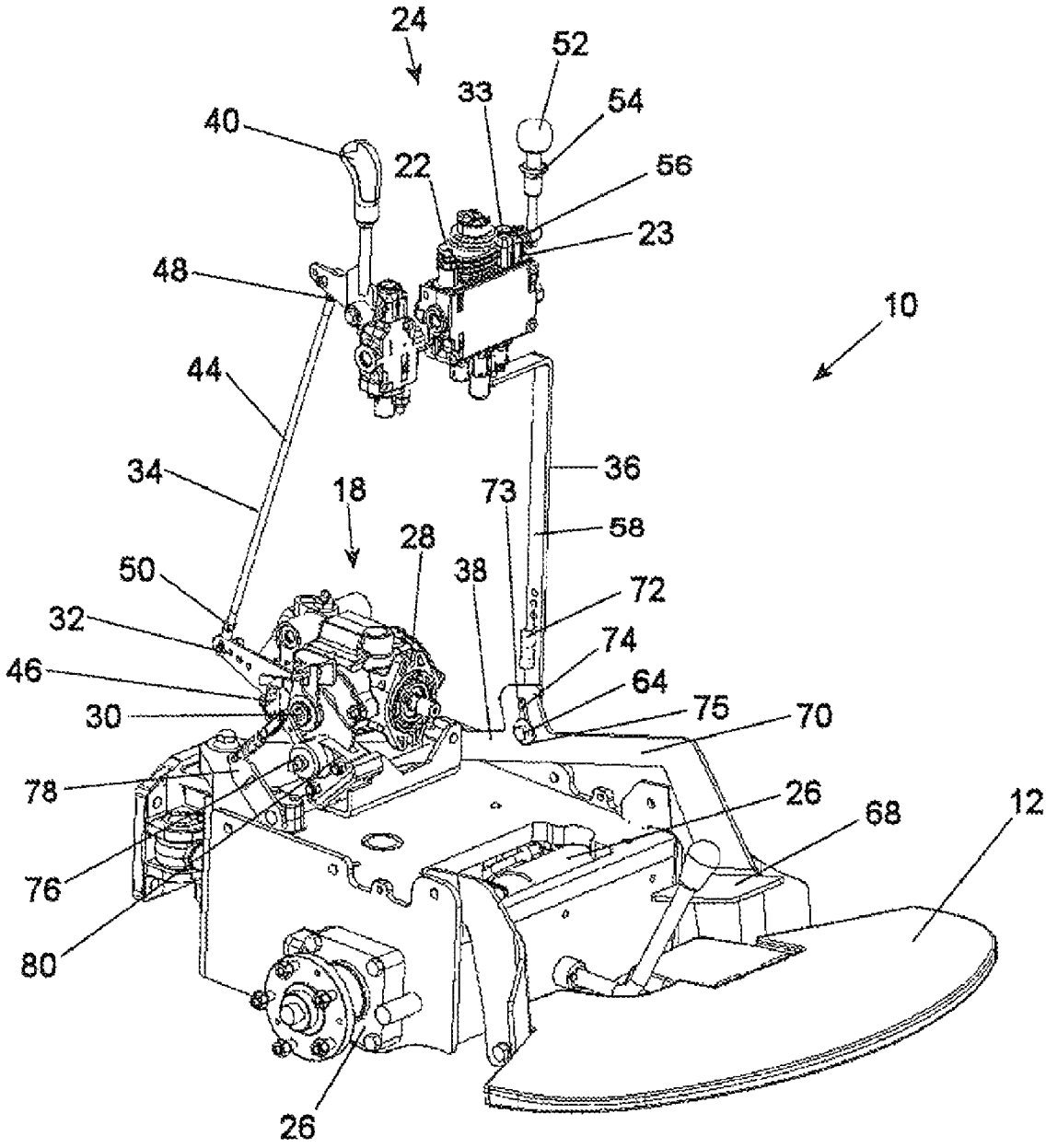
FIG. 2 is a partial perspective cut-away of the work machine of FIG. 1.

With reference now to FIG. 2, the ground drive system 18 provides operational power to the drive members 16, Preferably, the drive system 18 comprises one or more ground drive motors 26, a pump 28, a pump control shaft 30, and a pump control arm 32. The motors 26 are operatively connected to the pump 28 and translate power to the drive members 16. A position of the pump control shaft 30 determines an output speed of the ground drive system 18 or more specifically the output speed of ground drive motors 26. The pump control arm 32 is operatively connected to the pump control shaft 30. The position of the pump control arm 32 determines forward or reverse motion and a relative speed to the at least one ground supporting drive member 16. The pump control arm 32 allows the operator to set the speed of the drive members 16 in a manner yet to be described.

As described above, the work tool 20 may comprise any work implement for control by an operator from the control station 24. The work tool drive 22 is operatively connected to the work tool 20 and allows the operator to control the operation of the work tool. In the preferred embodiment, the work tool drive 22 comprises an actuator 23 operable to put the work tool in either an engaged mode or an off mode. More preferably, the work tool drive 22 comprises a hydraulic control valve 33 having a spool proximate the control station 24. When the actuator 23 is in the engaged mode, the control valve 33 allows hydraulic fluid to flow and the work tool 20 to operate. When the actuator 23 is in the off mode, the control valve 33 allows no hydraulic fluid to flow and the work tool 20 is inoperative. One skilled in the art will appreciate the drive 22 or actuator 23 may also provide other modes of operation, including having variable operating speeds.

The control station 24 is adapted to allow for control of the operation of the work machine 10. The control station 24 preferably comprises a ground drive control 34, a work tool control 36, and a control stabilizer 38. The ground drive control 34 is adapted to adjust the output speed of the ground drive system 18, and thereby control the speed of the ground drive engaging members 16. The work tool control 36 is adapted to move the work tool drive 22 between the engaged mode and the off mode. The control stabilizer 38 is adapted to maintain the position of either or both of the ground drive control 34 and the work tool control 36. By maintaining the position of the controls 34 and 36, the stabilizer 38 maintains the operational parameters controlled by the controls.

In the preferred embodiment, the ground drive control 34 comprises a ground drive control lever 40, a ground drive control link 44, and a spring centering device 46. The ground drive control lever 40 is preferably a return-to-neutral control and movable to a plurality of positions, including a neutral position. The ground drive control link 44 is connected at a first end 48 to the control lever 40 and at a second end 50 to the pump control arm 32. Thus, the adjustment or movement of the ground drive control lever 40 from the neutral position by an operator directly controls the control link 44 and, thereby, the orientation of the pump control arm 32. Preferably, pushing the ground drive control lever 40 forward adjusts the pump control arm 32 to impart forward motion to the at least one ground supporting drive member 16. When the lever 40 is in the neutral position, the control arm 32 and the pump shaft 30 will also be in neutral, and the system 18 does not provide power to the ground supporting drive members 16. The spring centering device 46 is adapted to bias the pump control arm 32 in a neutral position. Thus, when the ground drive control lever 40 is not engaged, the spring centering device 46 will bias the pump control arm 32, and thus the control lever, to the neutral position.

With continued reference to FIG. 2, the work tool control 36 comprises a work tool control lever 52, a work tool control lock 54, a biasing member 56, and a work tool control link 58. The work tool control lever 52 is operatively connected to the control valve 33 of the work tool drive 22 and is preferably movable between an engaged position and an off position. In the preferred embodiment, when the lever 52 is moved to the engaged position, the lever operates to open the control valve 33 and cause the drive 22 to be in the engaged mode. When the work tool control lever 52 is in the off position, the lever operates to close the control valve 33 and the drive 22 will be in its off mode so that the work tool is inoperable.

The work tool control lock 54 is adapted to prevent the work tool lever 52 from moving to the engaged position without first unlocking the work tool control lock. In the preferred embodiment, the work tool lock 54 comprises a ring around the work tool control lever 52. Preferably, the work tool lock 54 is adapted to fit inside a cavity (not shown) defined by the control panel 25. More preferably, the work tool lock 54 is gravity-biased to engage the cavity when the work tool control lever 52 is in the off position. To use the work tool control lever 52, the work tool lock 54 must first be lifted out of the cavity. The work tool 20 may then be operated by adjustment of the work tool control lever 52. When the work tool control lever 52 is returned to its off position, the work tool lock 54 will return to the cavity and lock the lever 52 in the off position.

The biasing member 56 is used to bias the lever 52 to the off position. Preferably, the biasing member 56 comprises a spring-biased spool in the control valve 33. Alternatively, the biasing member 56 may comprise a spring or other mechanism as is common in the art. The work tool control link 58 operatively connects the work tool control 36 with the control stabilizer 38. Preferably, the work tool control link 58 comprises a pin 64 that operatively engages the control stabilizer 38 in a manner yet to be described.

The control stabilizer 38 is operatively connected to the ground drive control 34 and the work tool control 36. The control stabilizer 38 allows an operator to selectively maintain one or both of the ground drive control 34 and the work tool control. 36 in their respective positions as selected by the operator. Preferably, the control stabilizer 38 comprises a mechanical control movable to a plurality of positions selectively by the operator. Alternatively, the stabilizer 38 may be a switch with multiple positions and electrically connected to the controls 34 and 36. In the preferred embodiment, the control stabilizer 38 comprises a foot pedal 68 and a pedal arm 70. The foot pedal 68 is preferably located proximate the platform 12 where an operator stands to operate the machine 10 and is preferably movable between a plurality of positions. The pedal arm 70 is connected to the pedal 68 and moves as the pedal is moved between the plurality of positions.

For connecting the stabilizer 38 to the work tool control 36, the stabilizer further comprises a spring 72 and the pedal arm 70 defines a slot 74 to receive the pin 64 of the work tool control link 58. The spring 72 is connected between the pedal arm 70 and the work tool control link 58. The pin 64 and slot 74 arrangement allows for guided relative movement between the work tool control 36 and the pedal arm 70. Preferably, the slot 74 will have a dimension such that the pedal 68 could be permitted to be moved through the plurality of positions without the pin 64 contacting a top end 73 or a bottom end 75 of the slot. More preferably, the spring 72 and the pin 64 and slot 74 arrangement will have a coordinated connection so that when the control stabilizer 38 is not engaged, the pin 64 is located proximate the bottom end 75 of the slot 74.

For connecting the stabilizer 38 to the ground drive control 34, the stabilizer further comprises a brake assembly 76 operatively connected to the pedal arm 70 with a bell crank 78. Preferably, the brake assembly 76 is adapted to use friction to maintain the position of the ground drive control 34. More preferably, the brake assembly 76 comprises a pair of brake calipers 80. The brake calipers are operatively connected to the pump control arm 32 of the ground drive system 18.

As mentioned above, the foot pedal 68 of the control stabilizer 38 is movable between a plurality of positions. In a first position, the pedal 68 will be at "rest" and not affecting either the work tool control 36 or the ground drive control 34 as determined by the operator. Preferably, the pedal 68 is biased to the first position. Most preferably, in the first position the pedal 68 is raised off of the platform 12.

In a second position, the pedal 68 is preferably depressed approximately half way to the platform 12. In this position, the pedal 68 has the ability to affect only the work tool control 36 and will not affect the ground drive control 34. Preferably, the pedal 68 will be depressed to the second position when the operator wishes to maintain the work tool control lever 52 in the engaged position without having to physically hold the lever. As the operator engages the lever 52, the pin 64 of the work tool control link 58 will contact the bottom end 75 of the slot 74 to cause the pedal 68 to be moved to the second position. Alternatively, if the pedal 68 is depressed and the work tool lock 54 is not engaged, the pedal arm 70 will engage the control spring 72 connecting the pedal arm to the work tool control link 58, causing the work tool control lever 52 to be moved to the engaged position. With the pedal 68 in the second position, the spring 72 overcomes the force of the biasing member 56 of the work tool control 36, causing the work tool control to remain in the engaged position even as the operator releases the work tool control lever 52.

One skilled in the art could also envision methods to selectively establish the maximum movement of the work tool control lever 52. For example, a mechanically adjusted stop may be used that would establish a maximum displacement of the control lever 52.

More preferably, the spring 72 does not have sufficient force to overcome the force of the work tool lock 54. As discussed above, when in a locked position the lock 54 keeps the work tool control lever 52 in the off position. The lock 54, when engaged, will also keep the control stabilizer 38 from activating the work tool control 36 when the pedal 68 is in the second position. Thus, if the lock 54 is engaged as the pedal 68 is depressed, the control spring 72 will stretch and the work tool control lever 52 will remain in the off position. The pin 64 and slot 74 arrangement also allows relative movement between the pedal arm 70 and control link 58 preventing damage and allowing the control stabilizer 38 to perform other functions while the work tool control 36 is locked.

In a third position, the pedal 68 is preferably depressed substantially to the platform 12. In the third position, the pedal 68 will affect the ground drive control 34 and possibly the work tool control 36. If the work tool control 36 is unlocked, the stabilizer 38 will maintain the position of both the work tool control lever 52 and the ground drive control lever 40. However, if the work tool control lever 52 is in the off position as the pedal 68 is depressed through the second position, the control spring 72 will further extend, and the stabilizer 38 will maintain the position of only the ground drive control 34 when the pedal is in the third position.

When the pedal 68 is depressed to the third position, the brake assembly 76 will engage the ground drive system 18. In the preferred embodiment, the bell crank 78 is connected to the foot pedal 68 and operatively connected to the brake calipers 80. The brake calipers 80 are disposed proximate the pump control arm 32, and are operative to contact the pump control arm. When the pedal 68 is depressed to the third position, the bell crank 78 is moved, causing the brake calipers 80 to engage the pump control arm 32. Preferably, the frictional force applied to the pump control arm 32 by the brake calipers 80 is sufficient to overcome the bias effect of the spring centering device 46. More preferably, the brake calipers 80 of the control stabilizer 38 then maintain the position of the pump control arm 32 and the ground drive control lever 40, allowing the operator to release the ground drive control lever 40. With the brake calipers 80 engaged, the output speed of the ground drive system 18 is maintained without requiring the operator to hold the ground drive control lever 40 in place.

More preferably, the frictional force applied by the brake calipers 80 is sufficient enough to overcome the force of the spring centering device 46, but still will allow for the speed of the ground drive system 18 to be adjusted by manual operation of the ground drive control lever 40. In this embodiment, incremental changes to the speed of the ground drive system 18 can be made by the operator when the foot pedal 68 is fully depressed with the control stabilizer maintaining the new speed of the ground drive system.

One skilled in the art will appreciate enhancements and alternative embodiments for the control system of the present invention. For example, the brake calipers 80 could be engaged by an electric solenoid actuated by a simple electrical switch at the operator's foot or on the control panel 25. Additionally, other methods to selectively disable the mechanical connection between the control stabilizer 38 and the ground drive control 34 are contemplated. In such a configuration the foot pedal 68 would be used, even fully depressed, to only maintain the position of the work tool control 36, thus allowing the operator to freely control the ground drive system 18 with the work tool control activated. Such a configuration would be an alternative to that described above where the ground drive system 18 is maintained with the pedal 68 fully depressed while the work tool control 36 is available to be manipulated by the operator.

With reference again to FIG. 1, in an illustrative embodiment the work machine has a work tool 20 that comprises a trencher assembly 82. The trencher assembly 82 comprises a trenching boom 84 having a trenching chain 86 that is rotatable around the boom. In this embodiment, the function of the work tool control 36 may comprise operation of the trenching chain 86. When the foot pedal 68 is not engaged, the work tool control lever 52 is used to control the cutting function of the trenching chain 86 of the work tool 20 and the ground drive control lever 40 is used to control the ground speed of the machine 10.

As the pedal 68 is fully depressed to the third position, the brake calipers 80 engage the pump control arm 32, maintaining the speed of the ground drive system 18. The spring 72 and pin 64 and slot 74 arrangement maintain the work tool control 36 in the engaged mode. An operator can now maintain the operation of the machine 10, the engaged work tool 20 and the speed of the ground drive members 16, without the need to actively hold the ground drive control lever 40 or the work tool control lever 52. The speed of the machine 10 may still be incrementally changed by overcoming friction provided by the brake caliper 80 if the operator desires to move the ground drive control lever 40 to a different position. The operator may also disengage the work tool 20 by moving the work tool control lever 52 to the off position. When the operator releases the pedal 68, the pedal will be moved back to the first position, and the work tool control lever 52 and the ground drive control lever 40 will be biased to the off position and the neutral position respectively, causing the machine 10 to cease operation.

One skilled in the art will appreciate an operator can use the present invention to selectively determine which functions of the work machine 10 to control. Various modifications can be made in the design and operation of the present invention without departing from its spirit. Thus, while the principal preferred construction and modes of operation of the invention have been explained in what is now considered to represent its best embodiments, it should be understood that within the scope of the appended claims, the invention may be practiced otherwise than as specifically illustrated and described.

The invention claimed is:

1. A construction work machine comprising:

a frame;

a ground drive supported on the frame;

a work tool supported on the frame;

a ground drive control adapted to adjust an output speed of the ground drive;

a friction device adapted to maintain the output speed of the ground drive;

a work tool control movable between a plurality of positions and adapted to operate the work tool; and a control stabilizer adapted to selectively engage the friction device or to maintain the position of the work tool control or to simultaneously engage the friction device and maintain the position of the work tool control.

2. The machine of claim 1 further comprising:

a work tool drive;

wherein the work tool control is operatively connected to the work tool drive; and wherein the work tool control is movable between an engaged position and an off position, such that in the engaged position the work tool control is adapted to cause the work tool drive to be engaged and in the off position the work tool control is adapted to cause the work tool drive to be disengaged.

3. The machine of claim 1 wherein the friction device comprises a brake caliper.

4. The machine of claim 1 wherein the ground drive comprises a pump having a pump control arm;

wherein the friction device comprises a brake caliper adapted to engage the pump control arm and maintain a position of the pump control arm.

5. The machine of claim 4 wherein when the brake caliper engages the pump control arm the ground drive control may be moved to another of the plurality of positions such that the pump control arm is moved to a new position and the brake caliper will maintain the pump control arm in the new position.

6. The machine of claim 1 wherein the control stabilizer comprises an electric solenoid.

7. The machine of claim 1 wherein the control stabilizer comprises a pedal.

8. The machine of claim 7 wherein the pedal is movable between a plurality of positions;

such that in a first position the pedal does not engage the work tool control or the friction device; and such that in a second position the pedal is adapted to maintain a position of the work tool control; and such that in a third position the pedal is adapted to engage the friction device.

9. The machine of claim 8 wherein when the pedal is in the third position the pedal is further adapted to maintain a position of the work tool control.

10. The machine of claim 7 wherein the work tool control and the control stabilizer are connected by a spring.

11. The machine of claim 1 wherein the work tool control comprises a work tool lock, the work tool lock being movable between a locked position and an unlocked position;

such that when the work tool lock is in the locked position the work tool lock maintains the work tool control in the neutral position; and such that when the work tool lock is in the unlocked position the work tool control is movable between the engaged position and the off position.

12. The machine of claim 1 wherein the ground drive control comprises:

a lever; and a biasing member adapted to bias the lever to a neutral position,

13. The machine of claim 12 wherein the biasing member comprises a spring centering device.

14. The machine of claim 1 wherein the work tool control comprises:

a lever; and a biasing member adapted to bias the lever to an off position.

* * * * *